US005404674A

United States Patent [19]

Gethers, Jr.

[11] Patent Number: 5,404,674

[45] Date of Patent: Apr. 11, 1995

[54] RELEASABLE SECURITY SYSTEM FOR BUILDING OPENINGS

[76] Inventor: John Gethers, Jr., 1210 SW. 3rd Ave., Apt. N, Dania, Fla. 33004

[21] Appl. No.: 226,215

[22] Filed: Apr. 11, 1994

[51] Int. Cl.[6] ..... E05B 65/10; E06B 3/68

[52] U.S. Cl. ..... 49/141; 49/56

[58] Field of Search ..... 49/141, 56, 67; 292/21

[56] References Cited

U.S. PATENT DOCUMENTS

| | | | |
|---|---|---|---|
| 3,921,334 | 11/1975 | Black, Sr. | 49/141 X |
| 3,953,939 | 5/1976 | Klein | 49/56 |
| 4,055,360 | 10/1977 | Russi | 49/141 X |
| 4,207,706 | 6/1980 | Haines | 49/141 |
| 4,631,862 | 12/1986 | Gallardo | 49/56 |

*Primary Examiner*—Philip C. Kannan
*Attorney, Agent, or Firm*—J. Sanchelima

[57] ABSTRACT

A security system for protecting building openings with an iron work assembly for protecting the opening against unauthorized entries. The iron work assembly includes first and second portions that are rigidly mounted to each other along an abutting edge and the other portion is releasably mounted to the building. The portion that is releasable mounted to the building is of sufficient dimensions to permit a person through. A threaded positional rod has two sections joined to each other and they can be selectively maintained either coaxially with respect to each other or at another predetermined angle. A third headed section is coaxially and telescopically threaded to one of the two sections. A user keeps the sections at an angle when it wants to keep the security system locked and coaxially aligns them when the user wants to release it.

4 Claims, 4 Drawing Sheets

RELEASABLE SECURITY SYSTEM FOR BUILDING OPENINGS

BACKGROUND OF THE INVENTION

1. Field of the Invention

The present invention relates to security systems for iron bars used to secure building openings, and more particularly, to security systems of the collapsible type.

2. Description of the Related Art

A number of devices have been designed in the past to protect a building opening against trespassers. However, typically the more effective these systems are to keep the trespassers out, the more difficult it is for a dweller to exit through the opening in the event of an emergency.

SUMMARY OF THE INVENTION

It is one of the primary objects of the present invention to provide a security system that can be readily unlocked and a hingedly mounted portion of the protecting iron work released to permit occupants to exit the building.

It is another object of the present invention to provide a security system that is effective in protecting a user against trespassers while at the same time it is easy to operate.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
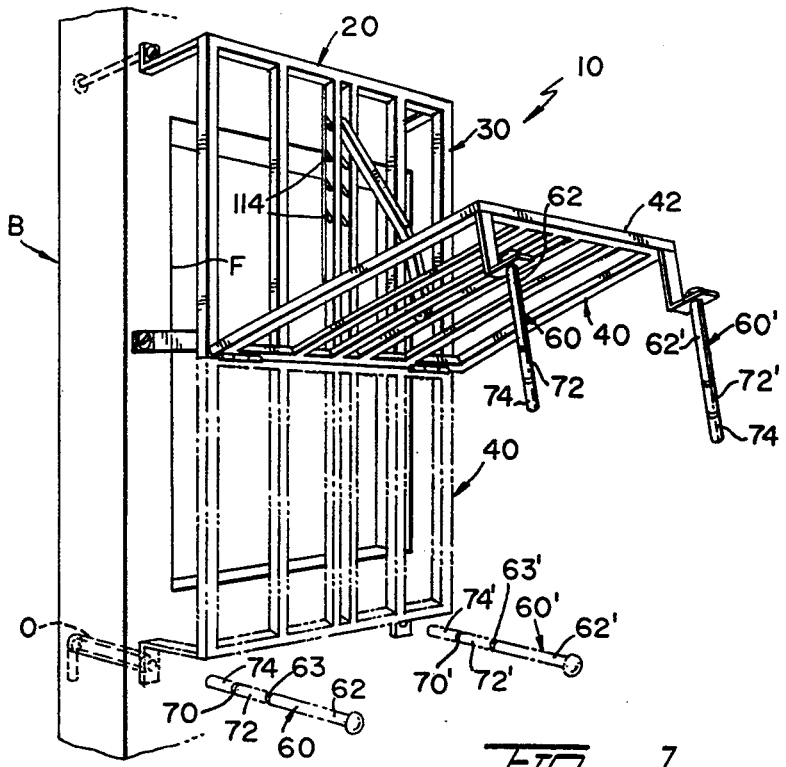
FIG. 1 represents the hingedly mounted portions of a security ironwork assembly incorporating the present invention in an isometric view.
Figure 2:
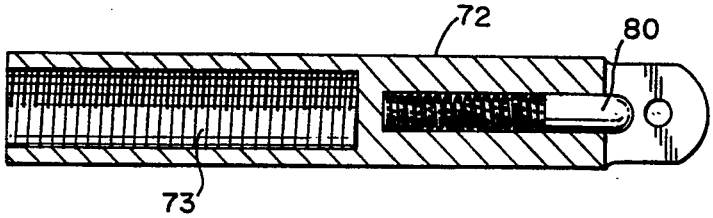
FIG. 2 shows a side cross-sectional view of one section of the threaded positional rod used to secure the movable portion of a security ironwork assembly.
Figure 3:
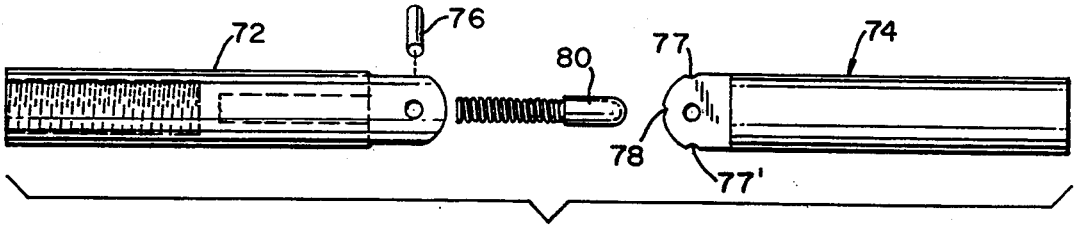
FIG. 3 is an exploded representation of the positional rod showing its two sections and the different components separated.
Figure 4:
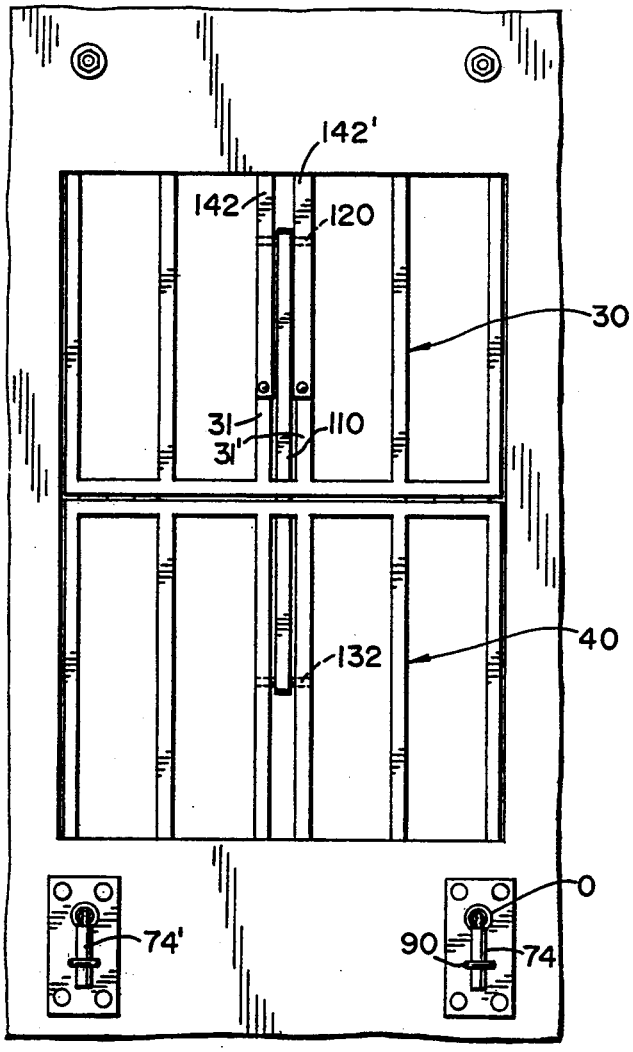
FIG. 4 is a front elevational view of the security system subject of the present application, as seen from inside the building being protected.

Referring now to the drawings, where the present invention is generally referred to with numeral 10, it can be observed that it basically includes ironwork 20 protecting opening frame F in a building B and iron work 20 includes two portions, 30 and 40, that are hingedly mounted to each other. In the preferred embodiment, upper portion 30 is rigidly mounted to building B and movable (lower) portion 40 is hingedly mounted to fixed (upper) portion 30 along its abutting edge which preferably centrally located. Free edge 42 of portion 40 is releasably mounted to building B, as it will be described in more detail below. In FIG. 1, lower and movable portion 40 is raised and its secured position is shown with numeral 40.

Figure 5:
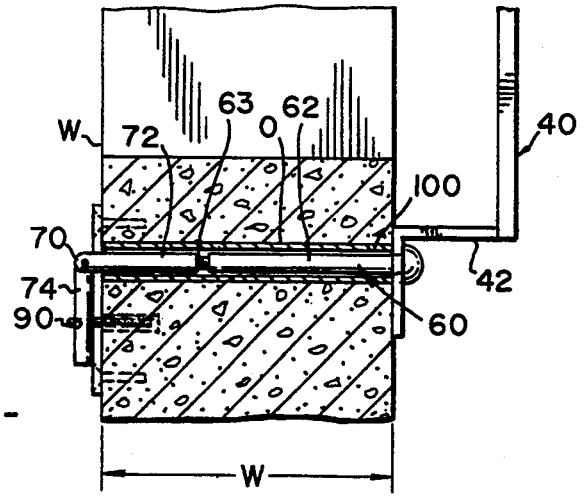
FIG. 5 is a partial cross-sectional view of the threaded positioned rod installed.

Threaded positional rod members 60 and 60' are inserted through orifices in building B. Rod members 60 and 60' include headed section 62 and 62' that terminate with threaded ends 63 and 63' that screw on internal thread 73 and 73' (not shown) of sections 72 and 72'. This permits a user to adjust to the effective length of rod member 60 to the width W of the opening. Through the use of spring loaded joint 70, sections 72 and 74 are kept at 90 degrees with respect to each other when security system 10 is locked as best seen in FIG. 5. Rod member 60 can be straighten out placing sections 72 and 74 in coaxial alignment with each other and permitting it to slide through orifice O. Pin member 76 pierces through sections 72 and 74 and acts as a hinge member. Section 74 includes concavity 78 against which spring loaded pin 80 is urged thereby maintaining the coaxial alignment between section 72 and 74 which will facilitate sliding rod member 60 through orifice O. Concavities 77 and 77' are, in the preferred embodiment positioned at 90 degrees with respect to concavity 78. However, other angles may also be selected. The preferred embodiment being at 90 degrees, permits section 72 to be set at a right angle with respect to sections 74 and 74' and will stay at that position until sufficient force is exerted to cammingly overcome the locking action of pin 80 when engaged inside cavity 73 or 77. Therefore, threaded positional rod member 60 can be set in a straight elongated position for sections 72 and 74 that permits introducing then through orifice O. After section 74 clears inner wall W, section 74 can be brought to a right angle position with respect to section 72. Hook member 90 is cooperatively mounted to wall W to engage section 74. Sleeve 100 permits a smooth insertion of rod member 60.

Figure 7:
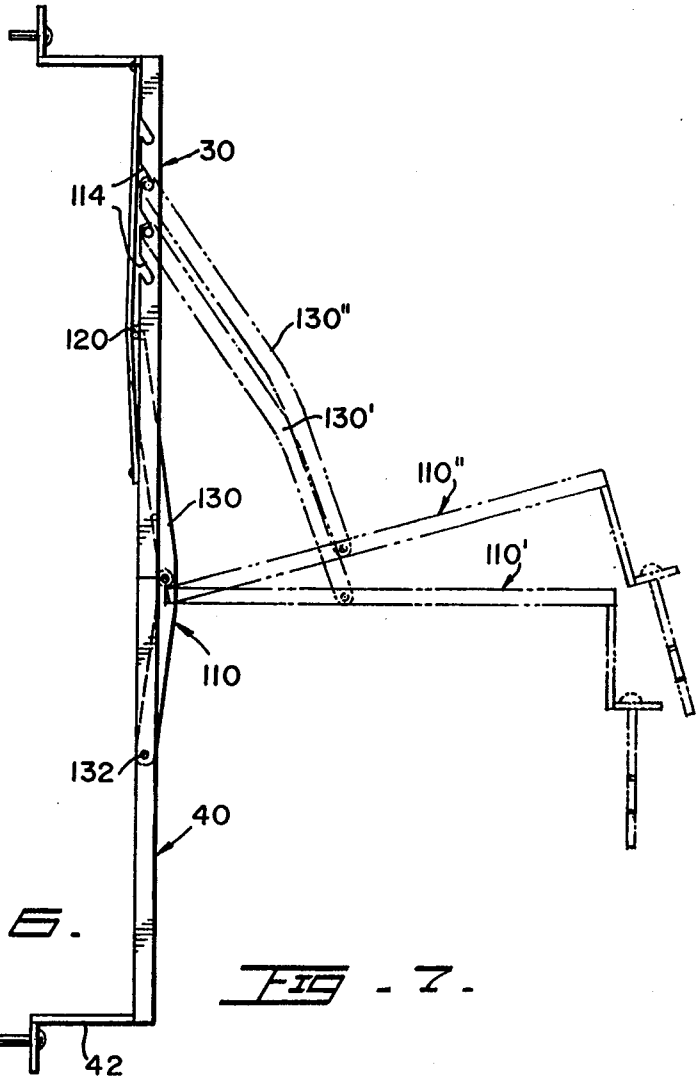
FIG. 7 is a side elevational view of the security system shown in the previous figure showing two latched positions, in phantom, for the movable portion of the ironwork.
Figure 6:
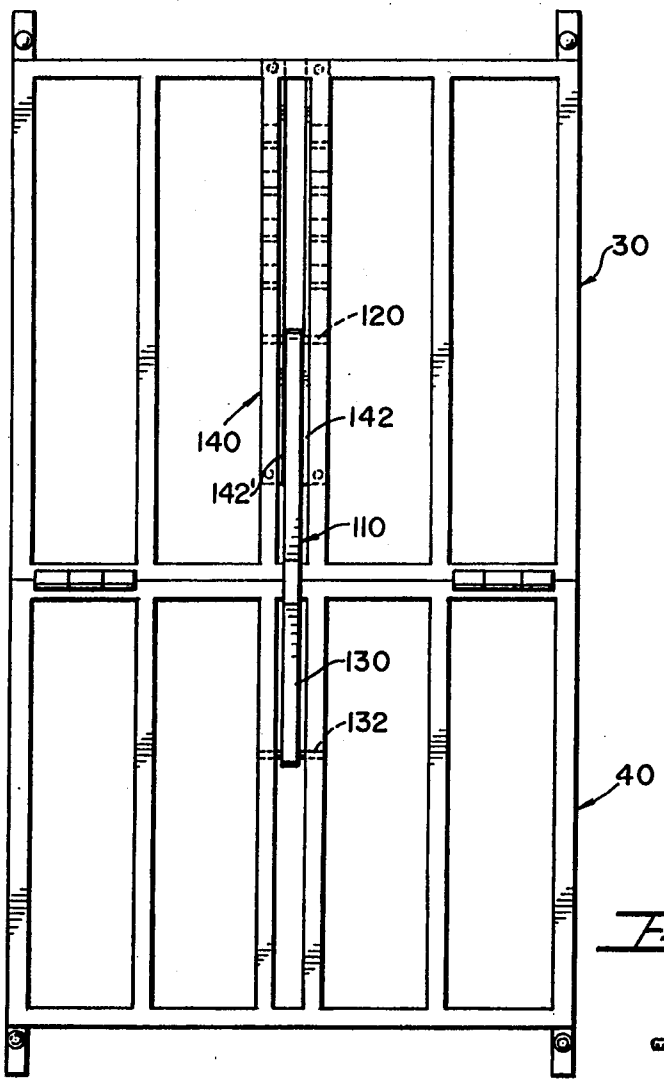
FIG. 6 is front elevational view of the security system subject of the present application, as seen from outside the building being protected.

Latching assembly 110 can be best seen in FIGS. 6 and 7. In FIG. 7, positions 110' and 110'' show two of several positions at which movable (lower) portion 40 can be positioned to permit a dweller to exit the protected building in case of emergency (fire, etc.).

Figure 8:
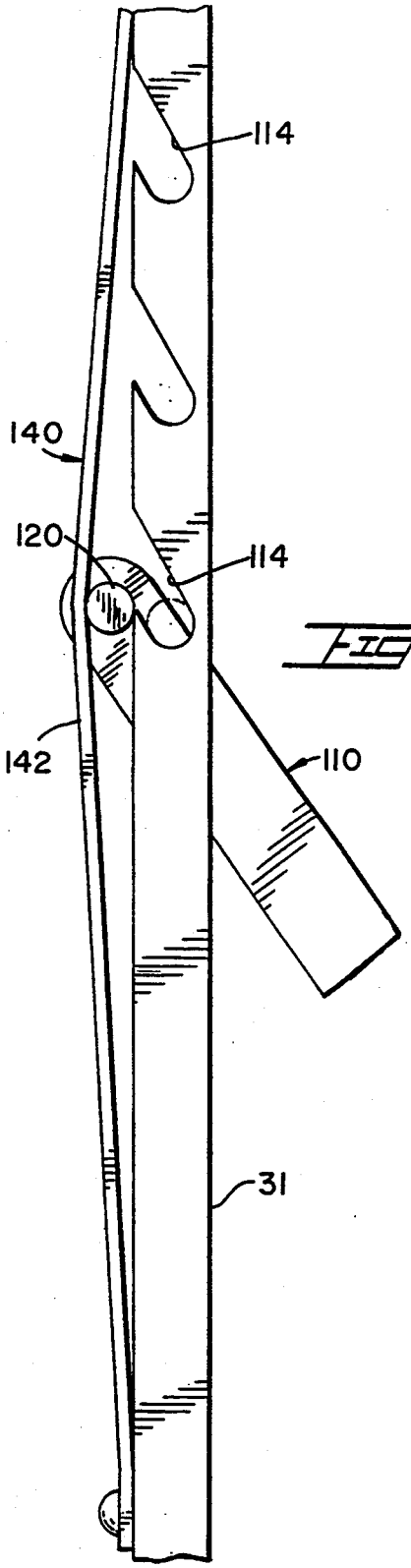
FIG. 8 is a side partial detail view of the latching assembly.
Figure 9:
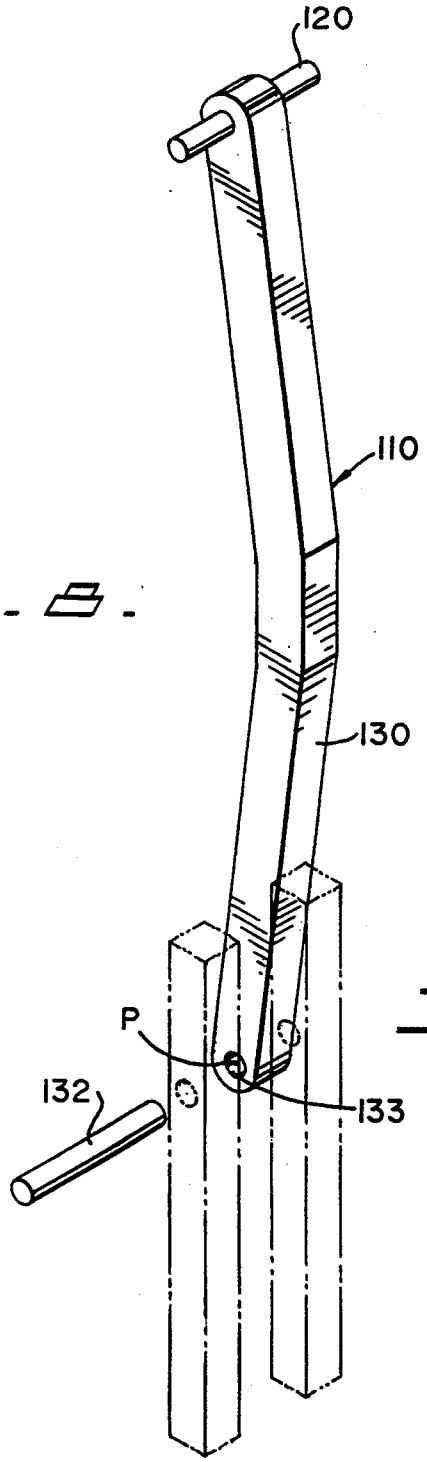
FIG. 9 is a partial isometric view of a portion of the latching assembly.

FIGS. 8 and 9 show in more detail the components for latching assembly 110 which includes elongated arm member 130. Cross pin 120 is rigidly mounted at the free end of elongated arm member 130. Member 30 is pivotally mounted to movable portion 40 by pivot pin 132 as seen in FIG. 7. Cross pins 120 are cooperatively received by notches 114. Pivot axis P includes through opening 133 through which pin 132 is inserted.

Spring biasing mechanism 140 includes spring leaves 142 and 142' that are rigidly mounted to members 31 and 31', as best seen in FIG. 8. Leaf 142 urges cross pin 120 against member 31 and when aligned with notches 114, it keeps pin 120 inside notch 114.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A security system for protecting against unauthorized entry of an opening in a building wall having at least one through orifice, comprising:

A. iron work means for protecting said opening including first and second portions hingedly mounted to each other along an abutting edge and said first portion being rigidly mounted to said building; and B. releasable locking means for keeping said second portion rigidly mounted to said building and said releasable locking means includes at least one threaded positional rod means having first and second sections and said first and second sections being pivotally joined to each other and further including means for selectively keeping said sections coaxially aligned with respect to each other thereby facilitating sliding said threaded positional rod means through said through orifice and said threaded positional rod means also includes means for selectively keeping said first and second sections at a predetermined angle with respect to each other so that the removal of said threaded positional rod means through said orifice is facilitated and said releasable locking means is mounted to said second portion and passes through said orifice.

2. The security system set forth in claim 1 further including latching means for selectively positioning said second portion at an angle with respect to said first portion so that a user can go through without having to overcome the weight of said hingedly mounted second portion.

3. The security system set forth in claim 2 wherein said latching means includes a plurality of positions at which said second portion can be set.

4. The security device set forth in claim 3 wherein said threaded positional rod means includes a third section having a head coaxially and telescopically mounted to said second section thereby permitting the adjustment of the length of said threaded positional rod means, so that said second and third sections cooperatively extend a distance slightly greater than the width of said wall.

* * * * *